US006749192B2

(12) United States Patent
Olson et al.

(10) Patent No.: US 6,749,192 B2
(45) Date of Patent: Jun. 15, 2004

(54) SKEW CORRECTION FOR A MEDIA FEED MECHANISM

(75) Inventors: Allan G. Olson, Camas, WA (US); R. Scott Smith, Vancouver, WA (US); Daniel J. Magnusson, Vancouver, WA (US); Kieran B Kelly, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 36 days.

(21) Appl. No.: 10/164,181

(22) Filed: Jun. 5, 2002

(65) Prior Publication Data

US 2003/0227130 A1 Dec. 11, 2003

(51) Int. Cl.[7] ..... B65H 9/04
(52) U.S. Cl. ..... 271/21; 271/246
(58) Field of Search ..... 271/244, 246, 271/19, 21; B65H 9/04

(56) References Cited

U.S. PATENT DOCUMENTS 5,494,277 A 2/1996 Flores
6,032,949 A 3/2000 Ando
6,089,773 A 7/2000 Bailey et al.
6,092,893 A * 7/2000 Yokoi et al. ..... 347/104
6,105,957 A * 8/2000 Miller et al. ..... 271/209
6,135,444 A 10/2000 Padget
6,135,447 A 10/2000 Lin
6,142,467 A * 11/2000 Funada ..... 271/246
6,315,284 B1 11/2001 Komuro et al.

FOREIGN PATENT DOCUMENTS

JP 3-177247 * 8/1991 ..... B65H/9/14

* cited by examiner

*Primary Examiner*—Donald P. Walsh
*Assistant Examiner*—Kenneth W Bower

(57) ABSTRACT

A media feed mechanism includes a picking device, a first feedroller and a second feedroller. The picking device picks a sheet of media from a media source. The first feedroller moves the sheet of media along a feed media path. During a skew correction phase, the first feedroller rolls in a forward direction feeding the sheet of media forward and the second feedroller turns in a reverse direction preventing the sheet of media from progressing past a nip of the second feedroller. This results in skew correction. After skew correction is performed, the second feedroller turns in the forward direction advancing the sheet of media for printing.

14 Claims, 8 Drawing Sheets

SKEW CORRECTION FOR A MEDIA FEED MECHANISM

BACKGROUND

The present invention relates to sheet feeding of media and pertains particularly to skew correction for a media feed mechanism.

In printers and other devices that require sheet feeding of media, it is very important to position the image relative to the edges of the media. Some printers use active skew correction during media feeding. When positioning media, many considerations need to be taken into account for optimal performance.

For example, a feeding mechanism needs to provide correct positioning of media for printing. Top skew correction is necessary to line up the image relative to the top of the media. Side skew correction is necessary to line up the image relative to the side of the media. Heavy weight media or sticky media may require greater amount of skew correction. Lighter weight media can be permanently damaged by skew correction that is too rough.

SUMMARY OF THE INVENTION

In accordance with the preferred embodiment of the present invention, a media feed mechanism includes a picking device, a first feedroller and a second feedroller. The picking device picks a sheet of media from a media source. The first feedroller moves the sheet of media along a feed media path. During a skew correction phase, the first feedroller rolls in a forward direction feeding the sheet of media forward and the second feedroller turns in a reverse direction preventing the sheet of media from progressing past a nip of the second feedroller. This results in skew correction. After skew correction is performed, the second feedroller turns in the forward direction advancing the sheet of media for printing.

DESCRIPTION OF THE PREFERRED EMBODIMENT

Figure 1:
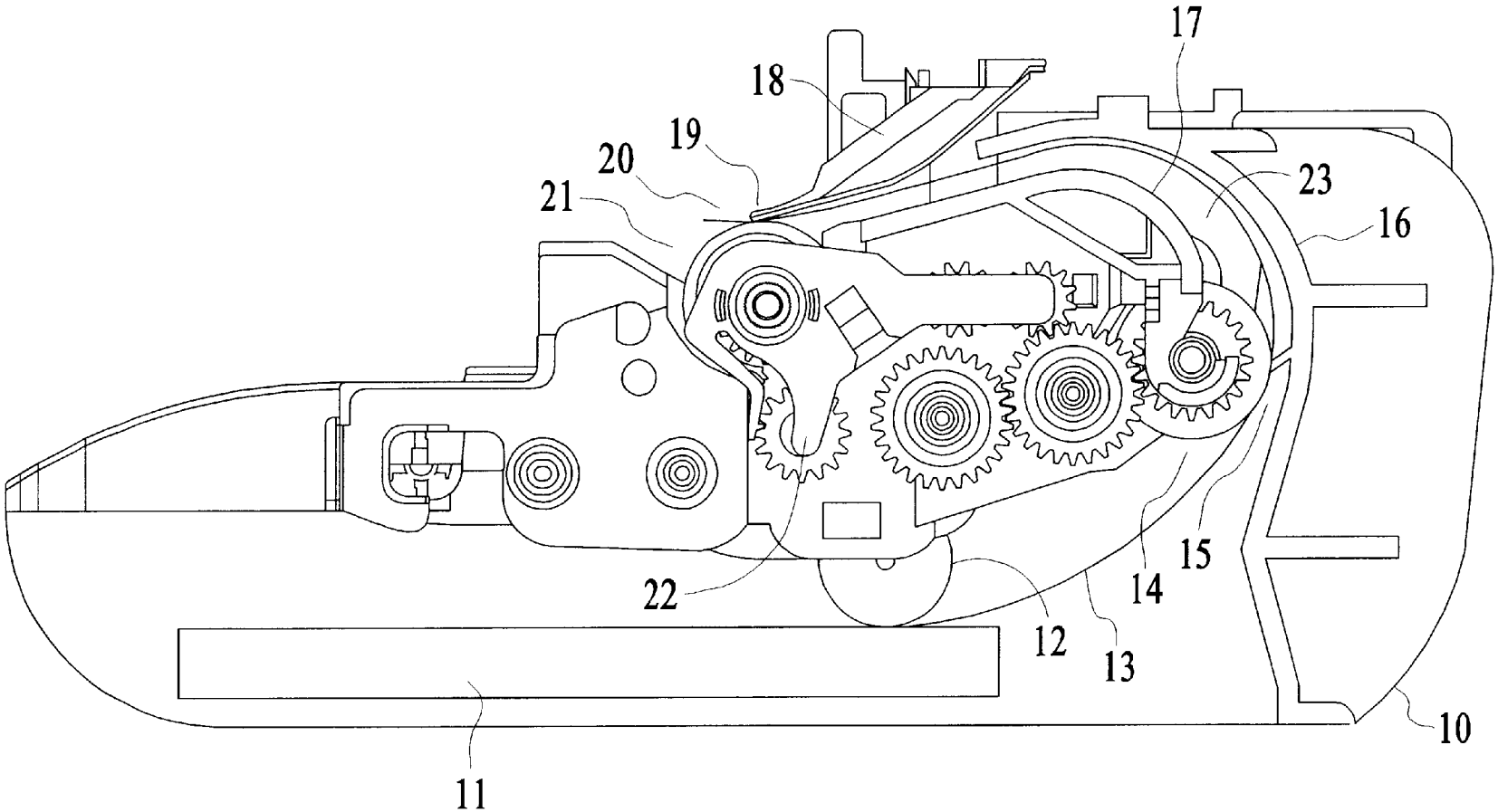
FIG. 1 is a side view of a printer simplified to illustrate media feed and skew correction in accordance with an embodiment of the present invention.

FIG. 1 is a side view of a printer 10 simplified to illustrate feeding and skew correction of a sheet of media 13.

In one embodiment of the present invention, media feed begins when a feedroller 21 rotates in reverse and acts as a drive mechanism for activating a pick tire 12 and a feedroller 14. Pick tire 12 is used to forward sheet of media 13 from a media stack 11 to feedroller 14. Feedroller 14 feeds sheet of media 13 around a media path bounded by a cleanout guide 16, an upper media guide 18 and a platen 17. Sheet of media is thus redirected 180 degrees and guided into feedroller nip 19 at a pinch roller 20. The length of the media path from pick tire 12 to pinch roller nip 19 is short enough (e.g., less than or equal to five inches) to ensure that another sheet of media is not picked before skew correction is completed and another pick cycle is initiated.

The pinch force created by feedroller 21 is greater than the pinch force created by feedroller 14. Since feedroller 21 rotates in reverse, sheet of media 13 will not feed past feedroller nip 19. Feedroller 14 overdrives sheet of media 13 into feedroller nip 19 of reversing feedroller 21, actively squaring sheet of media 13 relative to feedroller nip 19. This active squaring of sheet of media 13 occurs within a skew correction phase. The force of feedroller nip 19 is greater than feedroller 14 enabling sheet of media 13 not to push past feedroller nip 19 and to enable sheet of media 13 to slip back through a feedroller pinch 15. Space 23 is provided between feedroller 14 and feedroller 21 for lighter weight media to form a large buckle. This is useful when using lighter weight media that is not stiff enough to be pushed back past feedroller 14.

Figure 2:
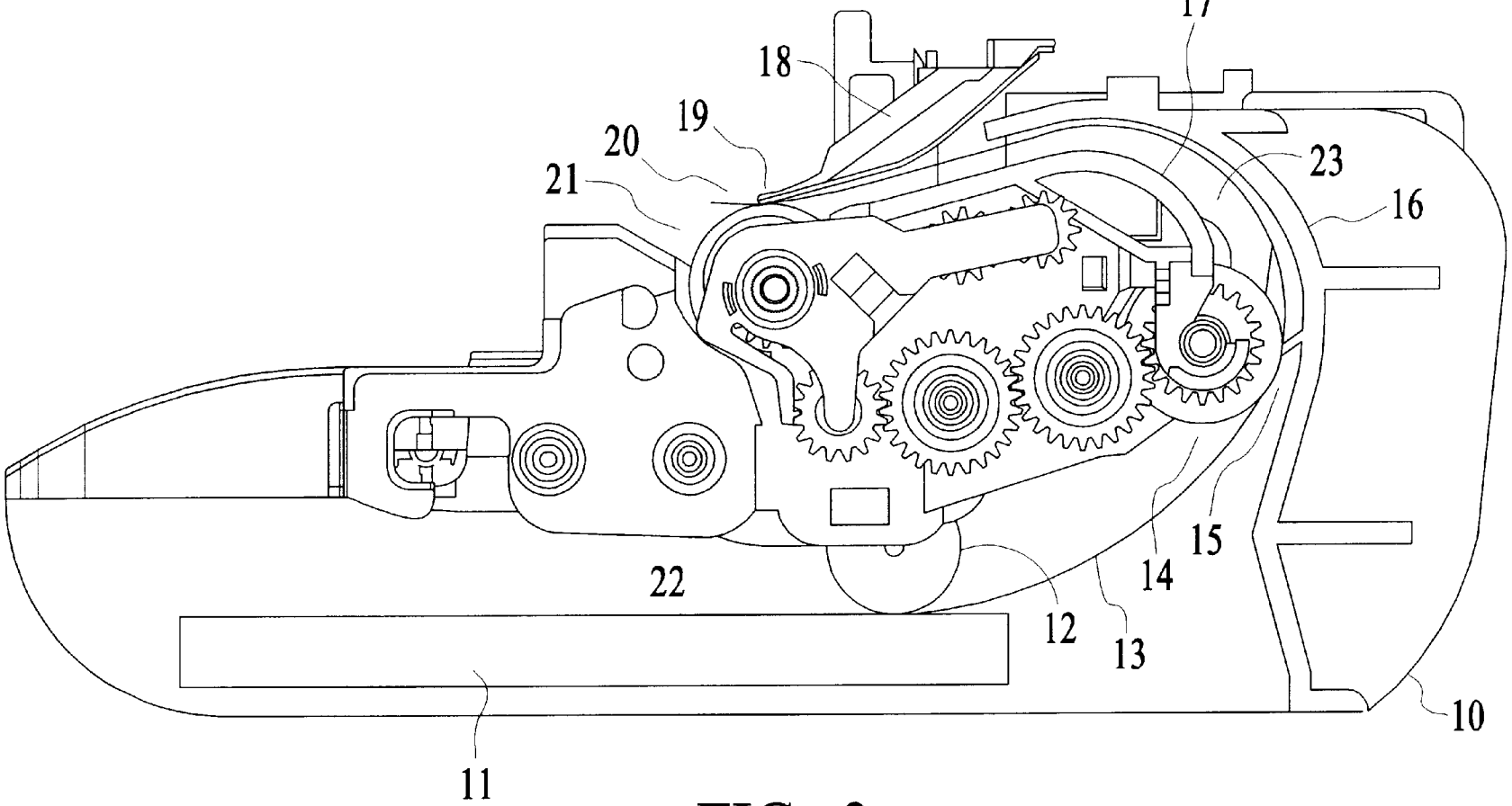
FIG. 2 is a side view of the printer shown in FIG. 1 after a feedroller transmission changes gear in accordance with an embodiment of the present invention.

Feedroller 21 reverses direction to advance sheet of media 13 to top of form. For the first 6 millimeters (mm) of the feedroller advance, feedroller 14 loses motion while feedroller transmission 22 disengages from one gear and engages a different gear. The new position of feedroller transmission 22 is shown in FIG. 2.

The lost motion of feedroller 14 that occurs when feedroller transmission 22 disengages from one gear and engages a different gear enables sheet of media 13 to pull away from cleanout guide 16 at the top of the media path. When feedroller 14 is engaged once again, feedroller 14 continues to feed sheet of media 13 forward at the same rate as feedroller 21, ensuring (for most types of media) that sheet of media 13 does not drag on the surface of cleanout guide 16 at the top of the media path surface and does not drag on platen 17 at the bottom of the media path.

In an alternative embodiment of the present invention, feedroller 21 rotates in reverse and acts as the drive mechanism for activating pick tire 12 and feedroller 14. Sheet of media 13 is picked by pick tire 12 and fed to feedroller 14. The motion of feedroller 21 is reversed (so that feedroller 21 is rotating in the forward direction). This disengages and re-engages feedroller 14. Feedroller 14 always drives in the same forward direction.

Feedroller 14 redirects sheet of media 13 on a media path that turns sheet of media 13 180 degrees and just past feedroller nip 19. Feedroller 21 is reversed once again (so that feedroller 21 is rotating in the reverse direction) to drive sheet of media 13 back through feedroller nip 19. While feedroller 14 is disengaging and reengaging sheet of media 13 is able to get all the way back in front of feedroller nip 19 before feedroller 14 re-engages and drives sheet of media 13 into feedroller nip 19. This driving of sheet of media 13 into feedroller nip 19 by feedroller 14 corrects skew.

The pinch force of feedroller 21 is greater than the pinch force of feedroller 14. When feedroller 21 rotates in reverse, sheet of media 13 cannot feed past feedroller nip 19. Feedroller 14 overdrives sheet of media 13 into feedroller nip 19 of reversing feedroller 21, actively squaring sheet of media 13 relative to feedroller nip 19.

The force of feedroller nip 19 is greater than the force of feedroller 14, enabling sheet of media 13 not to push past feedroller nip 19 and to enable sheet of media 13 (provided sheet of media 13 is stiff enough) to slip back through feedroller pinch 15. Space is provided in the media path between feedroller 14 and feedroller 21 so that if sheet of media 13 is of lighter weight and not stiff enough to slip back through feedroller pinch 15, there will be room within the media path for the resulting buckle in sheet of media 13.

After skew correction, feedroller 21 reverses direction (so that feedroller 21 is rotating in the forward direction) to advance sheet of media 13 to top of form. For the first six millimeters (mm) of the advance of feedroller 21, feedroller 14 loses motion while feedroller transmission 22 disengages from one gear and engages with a different gear. This lost motion enables sheet of media 13 to pull away from cleanout guide 16 at the top of the media path. When feedroller 14 is engaged once again, feedroller 21 continues to feed sheet of media 13 forward at the same rate as feedroller 21, insuring sheet of media 13 does not drag on the surface of cleanout guide 16 at the top of the media path surface and does not drag on platen 17 at the bottom of the media path.

In printer 10, space 23 is sufficiently large so that when a lighter weight sheet of media buckles, there is room for the buckle without resulting in a permanent crease in the sheet of media. The large expanse of space 23 also enables printer 10 to correct for a greater amount of skew.

The action of feedroller transmission 22 results in lost motion of feedroller 14 whenever feedroller 21 reverses direction. The lost motion of the feedroller 14 enables sheet of media 13 to pull away from cleanout guide 16 at the top of the media path as feedroller 21 advances sheet of media 13 from feedroller nip 19 to the top of the media. Space 23 is sufficiently large to ensure that sheet of media 13 (for most types of media) does not touch the surface of cleanout guide 16 at the top of the media path surface or platen 17 at the bottom of the media path while sheet of media 13 is fed through. This eliminates unpredictable drag that exists between different types of media and thus improves the accuracy of positioning sheet of media 13 from top of the page to the bottom of the page.

The force of feedroller 14 force is sufficiently low to allow media to slip enabling media to be overdriven into feedroller nip 19 and to correct for a greater amount of skew.

The design of printer 10 allows sheet of media 13 to be feed continuously from pick directly into feedroller nip 19, reducing the time required to perform active skew correction.

During skew correction, printer 10 is programmed to ignore motor stalls. That is, when sheet of media 13 makes it into feedroller nip 19, printer 10 ignores motor stall of feedroller 14 as media is squared in feedroller nip 19 by overdriving feedroller 14. This is particularly important for the case when heavy or sticky media is used resulting in motor stall. Once the move is complete the firmware of printer 10 is again enabled to monitor motor stalls.

The design of printer 10, particularly the enlargement of space 23, prevents damage that can happen when media of lighter weight buckles. Vertical positioning of media is very accurate. Media throughput is fast. Printer 10 corrects for a large amount of top skew (image relative to top edge of sheet of media 13) and side skew (image relative to side of sheet of media 13). This skew correction eliminates adverse effects of customer loading. There is a large amount of skew available for media that is heavy or sticky. The skew correction of printer 10 is much better than skew performance of many high end printers.

Figure 3:
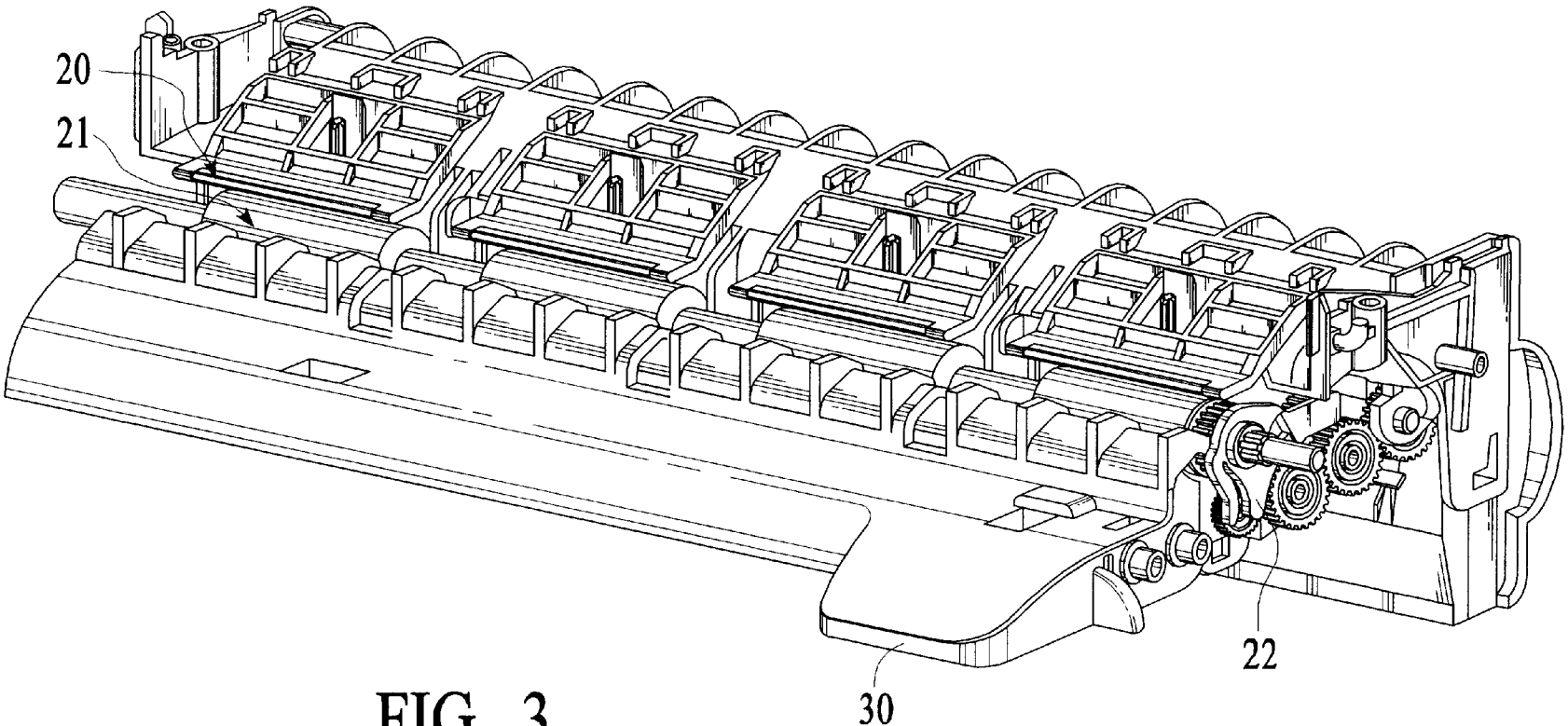
FIG. 3 is a perspective view of a portion of the printer shown in FIG. 1 in accordance with an embodiment of the present invention.

FIG. 3 is a perspective view of a portion 30 of printer 10. Feedroller 21, pinch roller 20 and feedroller transmission 22 are shown.

Figure 4:
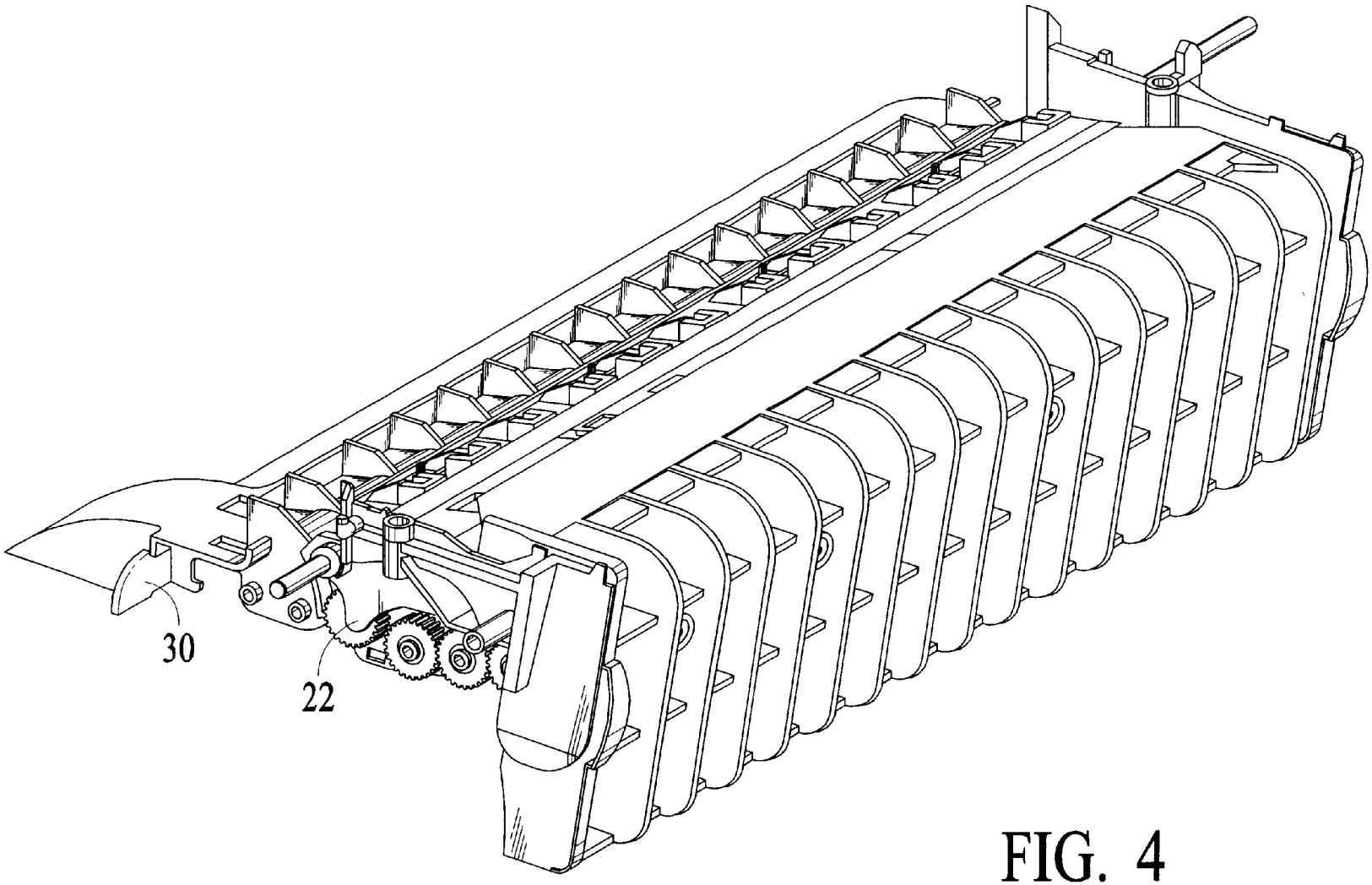
FIG. 4 is another perspective view of the portion of the printer shown in FIG. 3 in accordance with an embodiment of the present invention.

FIG. 4 is another perspective view of portion 30 of printer 10. Feedroller transmission 22 is shown.

Figure 5:
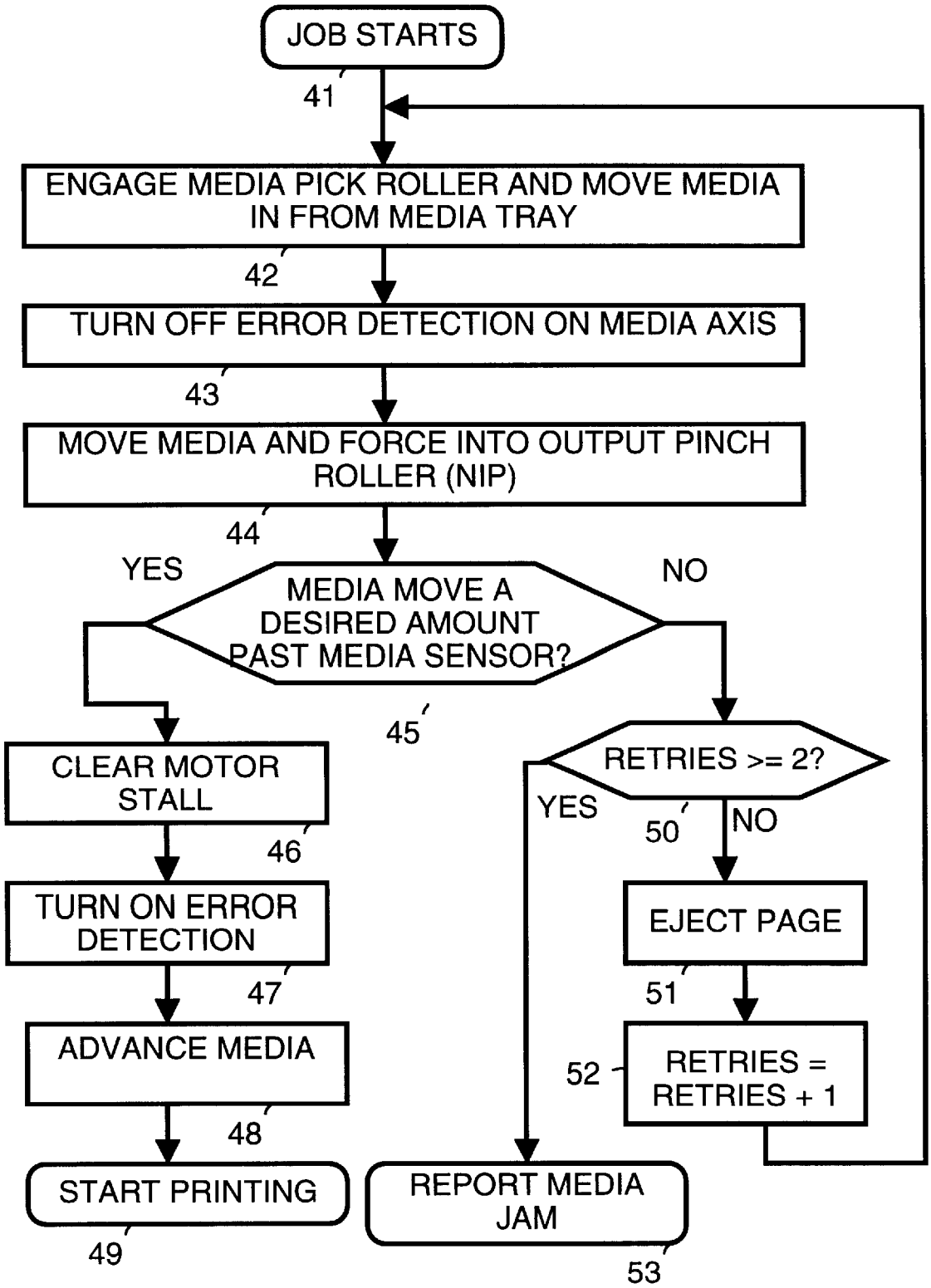
FIG. 5 is a flowchart that illustrates operation of media feed in accordance with an embodiment of the present invention.

FIG. 5 is a flowchart that illustrates operation of media feed. In a block 41, the job starts. At this point, retries equals zero. In a block 42, pick tire 12 engages sheet of media 13 and begins to move sheet of media 13 from media tray 11 past feedroller 14. In a block 43, error detection on the media axis is turned off. Error detection on the media axis indicates, for example, when feedroller 14 is stalled as the result of a media jam.

In a block 44, sheet of media 13 is forced against feedroller nip 19 at pinchroller 20. Since feedroller 21 rotates in reverse, sheet of media 13 will not feed past feedroller nip 19. This causes sheet of media 13 to buckle on top and will force the front edge of media 13 to sit against pinch roller 20. This move may cause the motor driving feedroller 14 to stall. This is acceptable because sheet of media 13 is being purposely overdriven into pinch roller 20. The potential of a motor stall is why error detection was turned off in block 43.

In a block 45, a check is made to see whether sheet of media 13 moved a desired amount past a media sensor. If sheet of media 13 moved the desired amount past a media sensor, this indicates a successful feed. In a block 46, any motor stall is cleared. In a block 47, error detection on the media axis is turned back on. In a block 48, sheet of media 13 is advanced forward to the first printable position. This move engages sheet of media 13 into pinch rollers 20 and feedroller 21. This pulls sheet of media 13 out straight, and takes up any slack created when sheet of media 13 was pushed into feedroller 21 when feedroller 21 was moving in reverse. In a block 49, printing is begun.

In block 45, when the check shows sheet of media 13 has not moved a desired amount past a media sensor, this indicates an unsuccessful feed. In a block 50, a check is made to see if retries is greater than or equal to two. If not, in a block 51, sheet of media 13 is ejected. In a block 52, retries is incremented. Then the process is repeated beginning in block 42.

If in block 50 retries is greater than or equal to two, in a block 53, a media jam is reported. This is a print failure.

Figure 6:
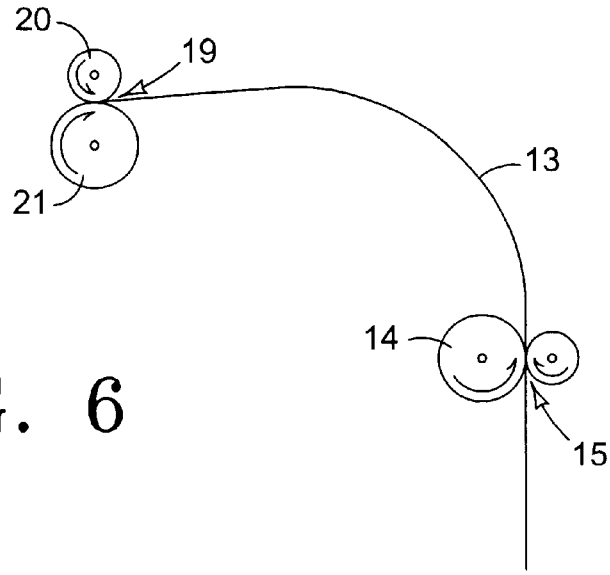
FIGS. 6–7 are schematic views illustrating the sequence of operation of the feedrollers according to one embodiment of the invention.
Figure 7:
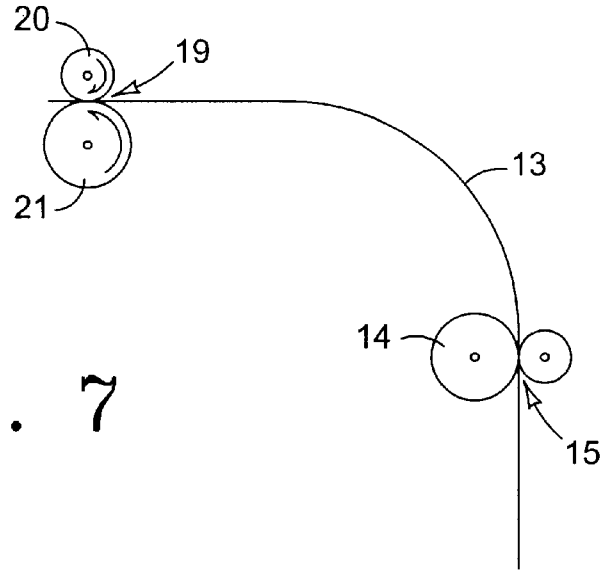
Figure 8:
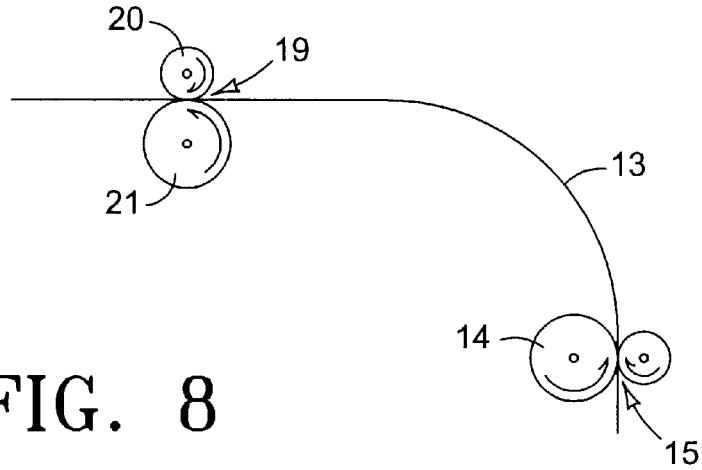

FIGS. 6–8 are schematic illustrations of one sequence of operation of feedrollers 14 and 21, as described above. In FIG. 6, during a skew correction phase, feedroller 21 turns in the reverse direction while feedroller 14 turns in the forward direction to push the leading edge of media sheet 13 squarely into nip 19. In FIG. 7, after skew correction, feedroller 21 turns in the forward direction and feedroller 14 halts, to pull the leading edge of media sheet 13 through nip 19. In FIG. 8, feedrollers 21 and 14 both turn in the forward direction to move media sheet 13 through the printer.

Figure 9:
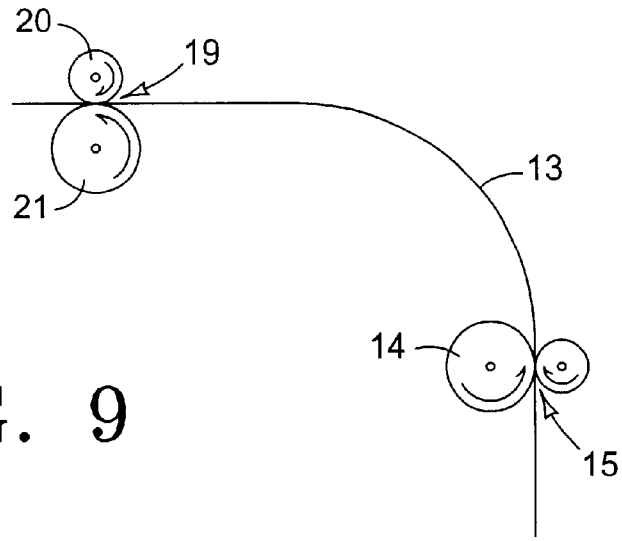
FIGS. 9–13 are schematic views illustrating the sequence of operation of the feedrollers according to a second embodiment of the invention.
Figure 10:
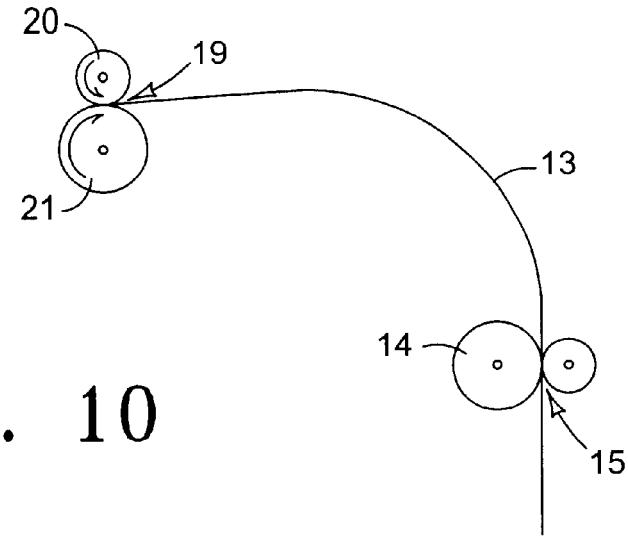
Figure 11:
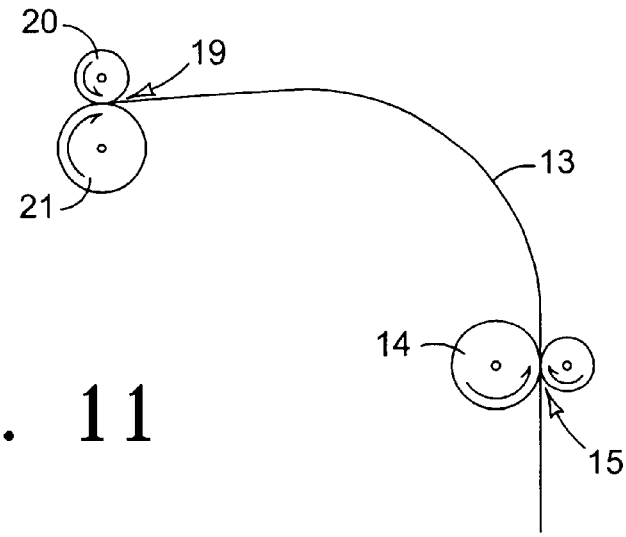
Figure 12:
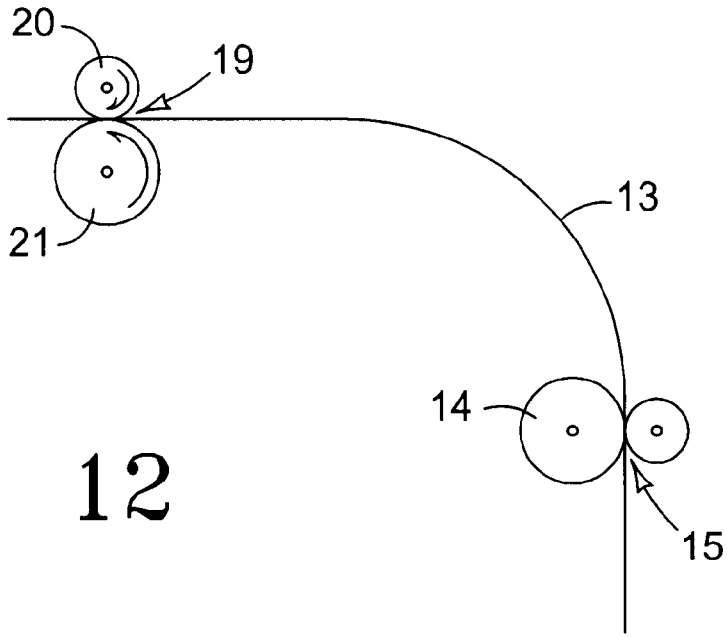
Figure 13:
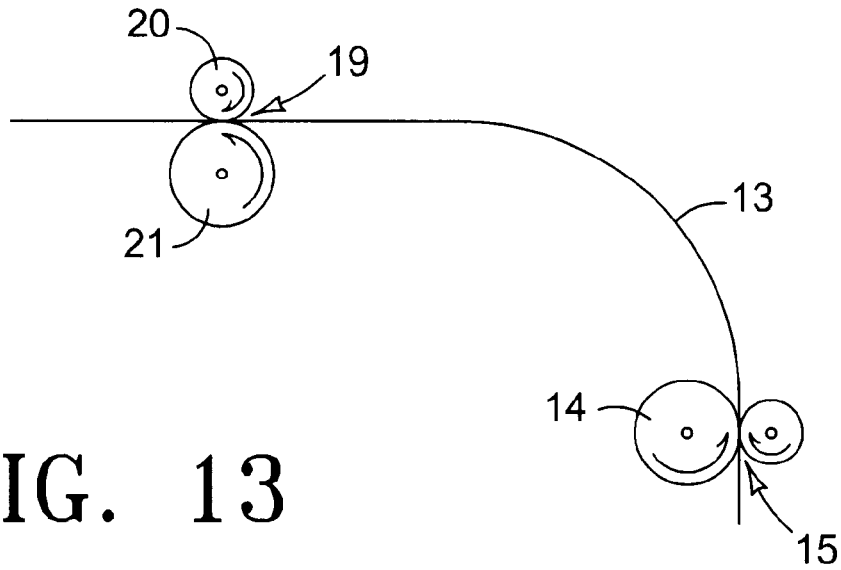

FIGS. 9–13 are schematic illustrations of another sequence of operation of feedrollers 14 and 21, as described above. In FIG. 9, both feedrollers 21 and 14 turn in the forward direction until the leading edge of media sheet 13 advances past nip 19. In FIG. 10, during a skew correction phase, feedroller 14 halts and feedroller 21 turns in the reverse direction to push the leading edge of media sheet 13 back through nip 19. In FIG. 11, feedroller 21 turns in the reverse direction while feedroller 14 turns in the forward direction to push the leading edge of media sheet 13 squarely into nip 19. In FIG. 12, after skew correction, feedroller 21 turns in the forward direction and feedroller 14 halts, to pull the leading edge of media sheet 13 through nip 19. In FIG. 13, feedrollers 21 and 14 both turn in the forward direction to move media sheet 13 through the printer.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A media feed mechanism, comprising:

a picking device that picks a sheet of media from a media source;

a first feedroller that moves the sheet of media along a feed media path;

a second feedroller;

wherein during a skew correction phase, the first feedroller rolls in a forward direction feeding the sheet of media forward and the second feedroller turns in a reverse direction preventing the sheet of media from progressing past a nip of the second feedroller resulting in skew correction;

wherein after skew correction is performed, the second feedroller turns in the forward direction advancing the sheet of media for printing; and wherein when the second feedroller changes direction from the reverse direction to the forward direction, the first feedroller is halted so that when the second feedroller begins turning in the forward direction, slack in the sheet of media between the first feedroller and the second feedroller is reduced.

2. A media feed mechanism as in claim 1, wherein the reduction of slack pulls the sheet of media away from a surface of the feed media path.

3. A method for performing sheet feeding of media, the method comprising:

obtaining a sheet of a media from a source using a picking device;

using a first feedroller to move the sheet of media along a feed media path including turning the first feedroller in a forward direction during initial feeding of the sheet of media;

turning a second feedroller in a reverse direction during a skew correction phase to prevent the sheet of media from progressing past a nip of the second feedroller;

after the skew correction phase, turning the second feedroller in the forward direction to advance the sheet of media for printing; and halting the first feedroller when the second feedroller changes direction from the reverse direction to the forward direction so that when the second feedroller begins turning in the forward direction, slack in the sheet of media between the first feed roller and the second feedroller is reduced.

4. A method as in claim 3 wherein the reduction of slack pulls the sheet of media away from a surface of the feed media path.

5. A method as in claim 3 further comprising turning off error detection on a media axis during the skew correction phase.

6. A method for performing sheet feeding of media, the method comprising:

obtaining a sheet of a media from a source using a picking device;

using a first feedroller to move the sheet of media along a feed media path, including turning the first feedroller in a forward direction during initial feeding of the sheet of media;

feeding the sheet of media past a nip of a second feedroller;

reversing direction of the second feed roller to back the sheet of media in front of the nip of the second feed roller, including halting the first feedroller from turning in the forward direction when the second feedroller backs the sheet of media in front of the nip of the second feedroller;

turning the first feed roller in the forward direction while turning the second feedroller in a reverse direction to correct skew; and after skew correction, turning the second feedroller in the forward direction to advance the sheet of media for printing.

7. A method as in claim 6 further comprising halting the first feedroller when the second feedroller changes direction from the reverse direction to the forward direction so that when the second feedroller begins turning in the forward direction, slack in the sheet of media between the first feedroller and the second feedroller is reduced.

8. A method as in claim 7 wherein the reduction of slack pulls the sheet of media away from a top surface of the feed media path.

9. A method as in claim 6 further comprising turning off error detection on a media axis during skew correction.

10. A media feed mechanism comprising:

a picking device that picks a sheet of media from a media source;

a first feedroller that moves the sheet of media along a feed media path;

a second feedroller;

a feedroller transmission that during a skew correction phase causes the first feedroller to roll in a forward direction and causes the second feedroller to turn in a reverse direction preventing the sheet of media from progressing past a nip of the second feedroller, wherein after skew correction is performed, the second feedroller turns in the forward direction advancing the sheet media for printing; and wherein when the second feedroller changes direction from the the reverse direction to the forward direction, the feedroller transmission disengages the first feedroller causing reduction of slack in the sheet of media between the first feedroller and the second feedroller.

11. A media feed mechanism as in claim 10, wherein the reduction of slack pulls the sheet of media away from a surface of the feed media path.

12. A media feed mechanism as in claim 10, wherein the media feed mechanism is within a printing device.

13. A media feed mechanism comprising:

a picking means for picking a sheet of media from a media source;

a first roller means for moving the sheet of media along a feed media path;

a second roller means;

a transmission means for, during a skew correction phase, causing the first roller means to roll in a forward direction and causing the second roller means to turn in a reverse direction preventing the sheet of media from progressing past a nip of the second roller means, wherein after skew correction is performed, the second roller means turns in the forward direction advancing the sheet of media for printing; and wherein when the second roller means changes direction from the the reverse direction to the forward direction, the transmission means disengages the first roller means causing reduction of slack in the sheet of media between the first roller means and the second roller means.

14. A media feed mechanism as in claim 13, wherein the reduction of slack pulls the sheet of media away from a top surface of the feed media path.

* * * * *

UNITED STATES PATENT AND TRADEMARK OFFICE

CERTIFICATE OF CORRECTION

PATENT NO. : 6,749,192 B2
DATED : June 15, 2004
INVENTOR(S) : Allan G. Olson et al.

It is certified that error appears in the above-identified patent and that said Letters Patent is hereby corrected as shown below:

Column 1,
Line 57, delete “7” and insert therefor -- 8 --

Column 5,
Line 60, delete “feed roller” and insert therefor -- feedroller --

Column 6,
Line 49, after “the” delete “the”

Signed and Sealed this

Nineteenth Day of April, 2005

JON W. DUDAS
*Director of the United States Patent and Trademark Office*